US005173311A

United States Patent [19]

Rensen

[11] Patent Number: 5,173,311

[45] Date of Patent: Dec. 22, 1992

[54] APPARATUS FOR MANUFACTURING BRICKS WITH SMOOTH SIDE SURFACES

[75] Inventor: Henricus G. R. Rensen, Bemmel, Netherlands

[73] Assignee: Machinefabriek De Boer B.V., Nijmegen, Netherlands

[21] Appl. No.: 313,798

[22] Filed: Feb. 22, 1989

Related U.S. Application Data

[62] Division of Ser. No. 59,009, Jun. 8, 1987, Pat. No. 4,832,587.

[30] Foreign Application Priority Data

Jun. 25, 1986 [NL] Netherlands ..... 8601671

[51] Int. Cl.[5] ..... B28B 5/02; B28B 7/38

[52] U.S. Cl. ..... 425/99; 425/220; 425/254; 425/443

[58] Field of Search ..... 425/99, 98, 357, 413, 425/220, 253-255, 443, 452

[56] References Cited

U.S. PATENT DOCUMENTS

| | | | |
|---|---|---|---|
| 83,244 | 10/1868 | Bovey | 425/99 |
| 143,569 | 10/1873 | Glendinning | 425/99 |
| 750,059 | 1/1904 | Oberdahn | 425/99 |
| 1,529,453 | 3/1925 | Strickland | 425/99 |
| 1,840,438 | 1/1932 | Faure | 425/99 |
| 4,378,202 | 3/1983 | Kosman | 425/99 |
| 4,610,616 | 9/1986 | Kosman | 425/99 |

FOREIGN PATENT DOCUMENTS

| | | | |
|---|---|---|---|
| 1809933 | 7/1969 | Fed. Rep. of Germany | 425/99 |
| 11276 | of 1846 | United Kingdom | 425/99 |

*Primary Examiner*—Jay H. Woo
*Assistant Examiner*—James P. Mackey
*Attorney, Agent, or Firm*—Webb, Burden, Ziesenheim & Webb

[57] ABSTRACT

A brick making device wherein clay is dispensed into moulds having sidewalls and a bottom movable relative to the sidewalls. A releasing material such as sand is dispensed by a rotating roller which intermittently forms a dispensing slit so that the releasing material is only applied to the mould bottom.

3 Claims, 3 Drawing Sheets

APPARATUS FOR MANUFACTURING BRICKS WITH SMOOTH SIDE SURFACES

CROSS-REFERENCE TO RELATED APPLICATION

This is a divisional of co-pending application Ser. No. 07/059,009 filed on Jun. 8, 1987, now U.S. Pat. No. 4,832,587.

FIELD OF THE INVENTION

The invention relates to a method and device for manufacturing bricks with smooth side surfaces.

DESCRIPTION OF THE RELATED ART

The mechanical manufacture of bricks with smooth side surfaces, so-called "Wasserstrichsteine" is not possible with the existing methods and on existing belt moulding-mould container machines. The problem is the discharging of the green brick out of the mould container. Since the side surfaces have to be smooth no releasing material can be used here for this purpose.

SUMMARY OF THE INVENTION

The invention has for its object to obviate this drawback and to enable the manufacture of said bricks on existing belt moulding systems. In accordance with the present invention the mould container is provided with a movable bottom. The mould container is washed, a layer of releasing material is placed in the container, and the container is filled with clay and trimmed off. In particular, only the bottom of the mould container is provided with the releasing material and the bottom is then moved so that it is virtually outside of the mould container. The device includes a circulating conveyor for supplying mould containers, a holder for releasing material, a holder for clay, means for carrying clay out of the holder and into the mould container, means for pressing the clay and trimming the mould container, and means for placing a drying plate onto the filled mould container. This device also includes a mechanism for displacing the bottom of the mould container and a mechanism for throwing up releasing material.

Since the bottom of the mould container is moved so as to be virtually outside the mould container, it is sufficient to have releasing material only on the bottom of the mould container. The friction force occurring between the walls of the mould container and the green brick are overcome by the outward pressure force applied to the bottom. Sand or sawdust, for example, can be used as releasing material.

BRIEF DESCRIPTION OF THE DRAWINGS

The invention is elucidated with reference to the annexed drawings of an embodiment.

In the drawings.

DESCRIPTION OF THE PREFERRED EMBODIMENTS

Figure 1:
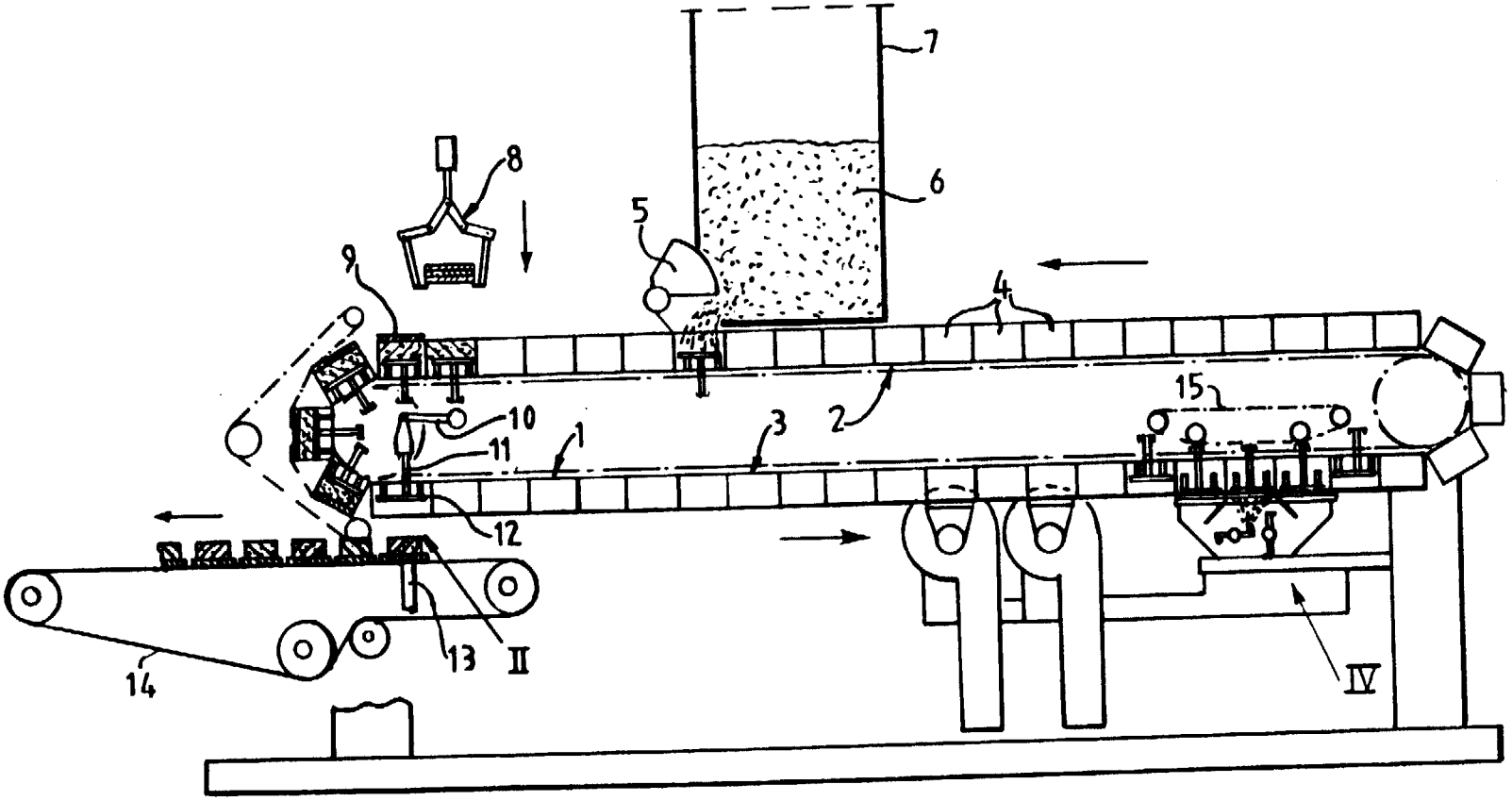
FIG. 1 shows a side view in diagrammatic form of the device for use with the method according to the invention.
Figure 2:
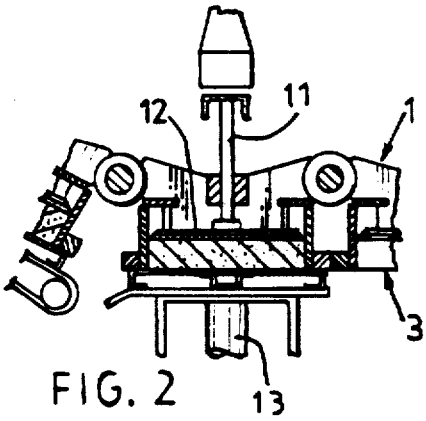
FIGS. 2 and 3 show the pressing out of the bottom in the device as in FIG. 1.
Figure 3:
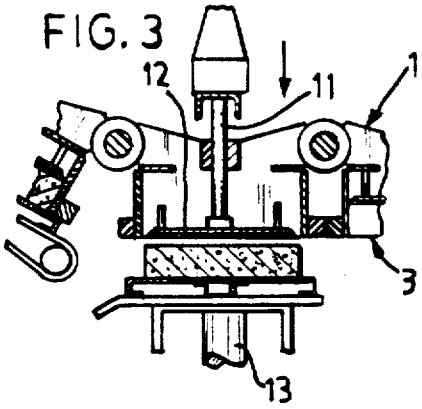
Figure 6:
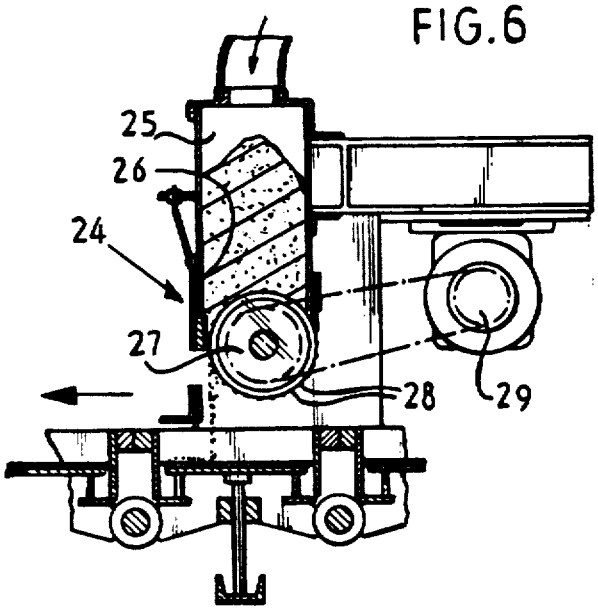
FIG. 6 is detail VI from FIG. 5 on a larger scale.

The device according to the invention comprises a conveyor 1 which transports mould containers 4 in a circulating path consisting of an upper part 2 and a lower part 3. Using the press-on and trimming member 5 clay 6 is carried from holder 7 into the mould container. A gripper device 8 places a carrying plate 9 onto the filled mould container. Using the press-out mechanism 10 and the base shaft 11 attached to bottom 12, the bottom 12 is pressed outside mould container 4. As a result the green brick, carried by carrying plate 9, comes onto a support member 13 which then transfers the green brick to the conveyor 14.

Care should be taken in performing the method that only the bottom of the mould container is provided with releasing material, for example sand or sawdust. Present for this purpose is a control mechanism in the form of a circulating belt 15, which moves the base shaft 11 and therefore the bottom 12 outward in the proximity of the throw-up mechanism 16. At this location (FIG. 4) the bottom 12 is virtually flush with the upper surface of mould container 4. Arranged close to throw-up mechanism 16 are two guide plates 17 and 18. The throw-up mechanism consists of a pair of rotating arms 19 and 20 which move through the supply of releasing material 21 in container 22. As a result of the rotation movement the releasing material is thrown upward and, guided by guide plates 17 and 18, carried onto only the bottom 12. Because the mould container is first washed with water, the releasing material remains adhered to the bottom. The walls of the mould container are very moist as excessive water is used to rinse the mould container.

Figure 4:
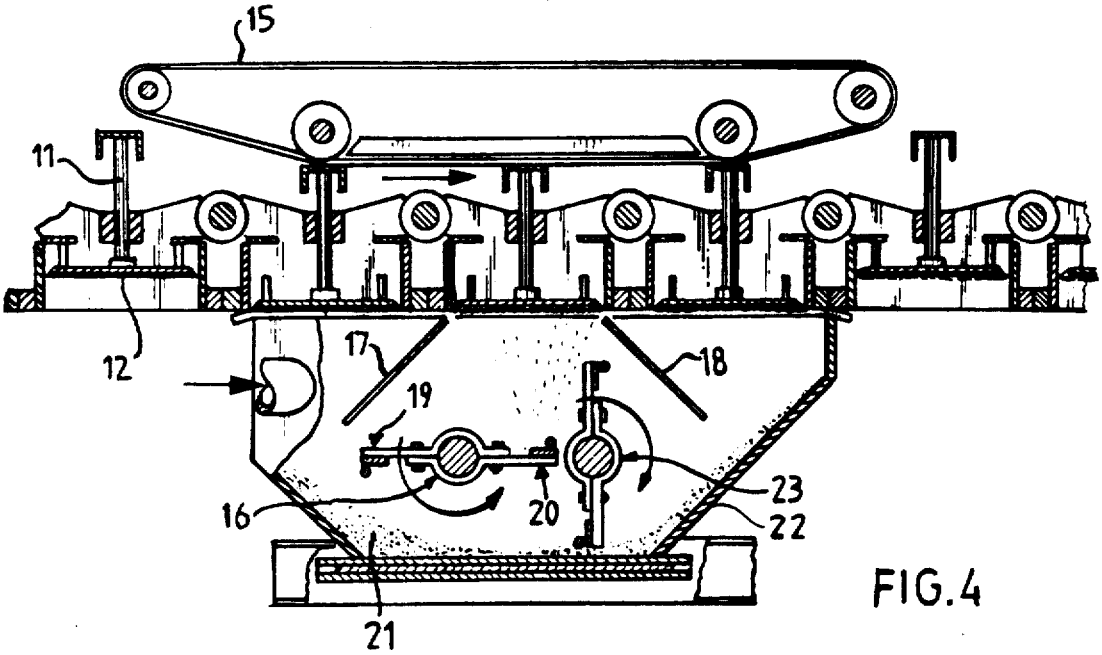
FIG. 4 is a view on a larger scale of the part IV from FIG. 1.

It is noted that two throw-up arms 16 and 23, which function in identical manner, are drawn in FIG. 4.

Since according to the invention the walls of the mould container are kept very moist there results a green brick with smooth side walls when pressing out takes place, the green brick releasing easily from the bottom as a result of the presence of releasing material on the bottom of the mould container.

Figure 5:
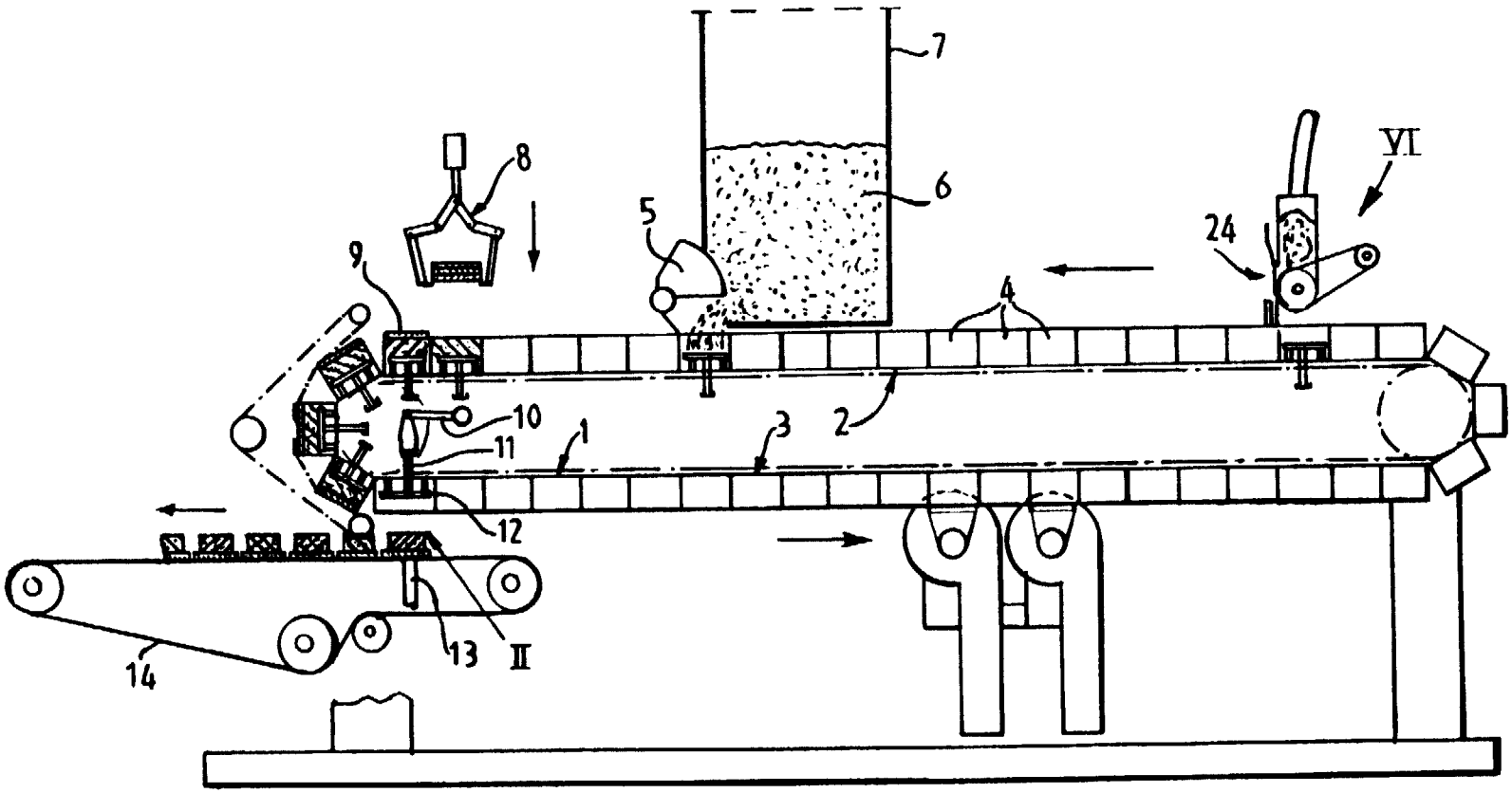
FIG. 5 shows an alternative embodiment.

FIG. 5 shows a second embodiment of the invention. By means of the dosing device 24 releasing material from a reservoir 25 is placed on the bottom of the mould container. A dosing device consists of a roller 27 rotating in the close proximity of the wall 26 of reservoir 25, the roller being provided on its surface with ribs 28 positioned at an interval from one another. The releasing material falls in a narrow band onto the bottom of the mould container while the latter moves beneath the slit-like opening between wall 26 and roller 27. Setting a dosing device into operation at the right moment by driving the roller 27 for rotation from the driving disc 29 ensures that the releasing material is applied only to the bottom of the mould container, while the walls of the mould container remain unaffected.

More particularly, the flow of releasing material from reservoir 25 of dosing device 24 is synchronized with the movement of the mould container therebelow, so that the releasing material falls in a narrow band onto the bottom of the mould container while the latter moves beneath the slit-like opening. By synchronizing the operation of the dosing device and the movement of the mould container, releasing material is prevented from reaching the side walls of the mould container.

I claim:

1. A device for manufacturing bricks with smooth side surfaces, comprising a conveyor carrying a plurality of open top mould containers in a circulating path, one portion of said path being substantially horizontal, each of said mould containers having sidewalls fixed relative to the conveyor and a bottom movable relative to said sidewalls, a first container for holding releasing material, said first container positioned adjacent said conveyor at a location where the top of mould containers open upward, a means associated with said first container for applying said releasing material on only the inner surface of the bottom of each of said mould containers, a second container for holding clay positioned adjacent said conveyor downstream of said first container at a location where the top of mould containers open upward, means associated with said second container for dispensing clay out of said second container and into said mould containers, means adjacent said conveyor for pressing the clay into said mould containers, means adjacent said conveyor for trimming excess clay from said mould containers, means for placing a drying plate across the open top of said filled mould containers and a first means adjacent the conveyor where the mould containers open downward for displacing the bottom of each mould container relative to the sidewalls thereby ejecting a formed brick with smooth sides, wherein said releasing material applying means comprises a rotating roller which intermittently forms a slit relative to a wall of the first container so that releasing material is only dropped onto the bottom of said mould containers.

2. The device as set forth in claim 1, wherein the releasing material applying means includes a rotating roller having on a surface thereof ribs positioned at an interval from one another to intermittently form a slit relative to a wall of the first container.

3. The device as set forth in claim 2, wherein the rotating roller is synchronized with the movement of the mould containers such that the releasing material falls in a narrow band onto the bottom of a mould container while the mould container moves beneath the slit.

* * * * *